US008991218B2

(12) United States Patent
Ulger et al.

(10) Patent No.: US 8,991,218 B2
(45) Date of Patent: Mar. 31, 2015

(54) WASHING MACHINE WITH OZONE GENERATOR

(75) Inventors: Zehra Ulger, Istanbul (TR); Erman Tutkak, Istanbul (TR); Emine Birci, Istanbul (TR)

(73) Assignee: Arcelik A.S., Istanbul (TR)

( * ) Notice: Subject to any disclaimer, the term of this patent is extended or adjusted under 35 U.S.C. 154(b) by 890 days.

(21) Appl. No.: 13/003,292

(22) PCT Filed: Jul. 7, 2009

(86) PCT No.: PCT/EP2009/058580

§ 371 (c)(1),
(2), (4) Date: May 23, 2011

(87) PCT Pub. No.: WO2010/003944

PCT Pub. Date: Jan. 14, 2010

(65) Prior Publication Data

US 2011/0226021 A1 Sep. 22, 2011

(30) Foreign Application Priority Data

Jul. 7, 2008 (TR) ..... 2008/05008

(51) Int. Cl.
*D06F 35/00* (2006.01)

(52) U.S. Cl.
CPC ..... *D06F 35/001* (2013.01); *D06F 35/007* (2013.01); *D06F 35/005* (2013.01)
USPC ..... 68/5 C; 68/12.12; 68/12.18; 68/13 R

(58) Field of Classification Search
CPC ..... D06F 35/001; D06F 35/007
USPC ..... 68/5 R, 5 C, 12.02, 12.12, 12.18, 13 R, 68/23 R
See application file for complete search history.

(56) References Cited

U.S. PATENT DOCUMENTS

| | | | | |
|---|---|---|---|---|
| 3,877,152 | A * | 4/1975 | Gorman | 34/524 |
| 5,688,289 | A * | 11/1997 | Nishioka et al. | 8/137 |
| 7,610,779 | B2 * | 11/2009 | Yang et al. | 68/12.02 |
| 2006/0021393 | A1 * | 2/2006 | Oda et al. | 68/231 |
| 2008/0092601 | A1 * | 4/2008 | Konides et al. | 68/13 R |
| 2009/0255299 | A1 * | 10/2009 | Hiro et al. | 68/19 |

FOREIGN PATENT DOCUMENTS

| | | | |
|---|---|---|---|
| EP | 1600545 | A | 11/2005 |
| EP | 1602766 | A | 12/2005 |
| EP | 1932962 | A1 | 6/2008 |
| EP | 1980660 | A | 10/2008 |
| JP | 7051500 | A | 2/1995 |
| JP | 2002320792 | A | 11/2002 |
| WO | 2007043326 | A | 9/2006 |
| WO | WO 2007043326 | A1 * | 4/2007 |

* cited by examiner

*Primary Examiner* — Joseph L Perrin
(74) *Attorney, Agent, or Firm* — Venjuris PC

(57) ABSTRACT

The present invention relates to a washing machine (1) wherein an ozone generator (4) that generates ozone gas is used for increasing the washing performance and providing sanitation. The ozone gas generated by the ozone generator (4) is delivered directly onto the clothes inside the tub (2) without mixing with the wash water and hence without dissolving in the wash water, and furthermore the ozone generator (4) that gets overheated due to operation at high voltage is cooled by the water used in the washing process.

4 Claims, 3 Drawing Sheets

WASHING MACHINE WITH OZONE GENERATOR

CROSS-REFERENCES TO RELATED APPLICATIONS

This applications claim priority of PCT Application no. PCT/EP2009/058580 filed Jul. 7, 2009 and priority of Turkish Application no. A 2008/05008 file Jul. 7, 2008 both of which are hereby incorporated herein by reference in their entireties.

FIELD

The present invention relates to a washing machine wherein ozone gas is used in the washing process.

BACKGROUND

In domestic washing machines, in some embodiments, ozone gas ($O_3$) having disinfectant and soil removal effects is used for increasing effectiveness of the washing process and to provide hygiene. By means of the ozone gas used in the washing process, the amount of detergent and water consumption decreases and since the washing process can be performed at lower temperature levels, energy saving is provided. In washing machines, when the ozone gas is delivered to the wash water, the ozone gas affected by the temperature and pH value of the water at least partially disintegrates into oxygen and the efficiency of the ozone is decreased. If the ozone gas is delivered to the washing medium at the washing steps wherein detergent is used, the ozone gas interacts with the detergent, deteriorating the chemical structure thereof and the cleaning efficiency of the detergent decreases. Furthermore, an ozone generator generating ozone gas is overheated due to operation at high voltage and low current level; the surface temperature rapidly rises after starting to operate. The efficiency of the ozone generator decreases due to overheating and the generation of ozone gas is reduced as the operation proceeds.

In the Patent Document No JP7051500, a device and a method used for sterilizing clothes are explained. In the said device, ozone gas is blown by an ozone generator onto the clothes agitated in the rotating drum and the air discharged out from the device is passed through a catalyst machine.

In the Patent Application No JP2002320792, in a washing machine, ozone generated by the ozone generator is fed into a washing tub for preventing propagation of various bacteria in the washing and drying operations.

In the Patent Application No WO2007043326, in a dryer or a washing machine or a washing machine having a drying function, ozone gas is applied in order to deodorize and sterilize the clothes being dried; ozone gas is sent onto the dry clothes in the tub before the washing process or after the drying process.

SUMMARY

The aim of the present invention is the realization of a washing machine comprising an ozone generator that provides ozone gas to be sent onto the clothes at appropriate program steps during the washing program, throughout the washing process.

The washing machine realized in order to attain the aim of the present invention is explicated in the claims.

The washing machine of the present invention comprises an ozone generator for sanitizing the washed items and ozone gas is delivered into the tub only at the spin drying steps wherein the drum is rotated at high speed. In the washing machine, at the spin drying step, clothes rotate with the drum without falling by clinging to the inner walls of the drum rotating at high speed and the ozone gas heading to the inner wall of the drum is provided to penetrate into the clothes completely. Furthermore, the water particles dispersing around in the drum by means of the centrifugal force formed in the drum provide the ozone gas to be carried onto clothes and the effect of the ozone gas on clothes is increased.

In an embodiment of the present invention, the ozone generator is operated continuously before the spin drying step starts, for example beginning from the main washing step at the beginning of the washing program, and the generated ozone gas is started to be delivered into the tub with the start of the spin drying step, thus the ozone generator is provided to reach the ozone gas level required for the spin drying step by operating in advance.

In another embodiment of the present invention, the ozone gas generated by the ozone generator which starts operating before the spin drying step, is not delivered into the tub but evacuated by means of an ozone discharge conduit without harming the user.

In another embodiment of the present invention, the ozone gas is directed from the ozone generator to the ozone discharge conduit except during the spin drying step and from the ozone generator into the tub during the spin drying step by means of a valve.

In another embodiment of the present invention, the ozone discharge conduit is connected to the waste water discharge conduit. Thus, unused ozone gas is discharged and at the same time microorganism accumulation and generation of unpleasant odor in the waste water discharge conduit are prevented.

In yet another embodiment of the present invention, the ozone generator overheating during operation is cooled by the water used in washing. In this embodiment, the water circulation line serves as a heat exchanger by surrounding the ozone generator like a coil to cool the ozone generator.

The washing machine realized in order to attain the aim of the present invention is illustrated in the attached figures, where:

SUMMARY

Elements shown in figures are numbered as follows:

1—Washing machine
2—Tub
3—Drum
4—Ozone generator
5—Ozone discharge conduit
6—Valve
7—Draining pump
8—Waste water discharge conduit
9—Circulation pump
10—Circulation line The washing machine (1) comprises a tub (2) wherein the washing operation is performed, a drum (3) positioned inside the tub (2) agitating the laundry emplaced therein and an ozone generator (4) generating ozone gas ($O_3$) and delivering the ozone gas into the tub (2) by means of an opening (A) arranged on the tub (2).

In the washing machine (1), the washing program (P) consists of a main washing step (W) which appears at the beginning and wherein detergent is used, and of spin drying (S) and rinsing steps following the main washing step (W) respectively and performed at least once each, wherein the drum (3) is rotated at high speed. After the main washing step (W) and 2, 3 or more times repeated spin drying (S) and rinsing (R) steps, the washing program (P) is finished by the final spin drying step (S) being executed. For example, the washing program (P) is realized by the main washing (W)—spin drying (S)—rinsing (R)—spin drying (S)—rinsing (R)—final spin drying (S) steps being performed respectively (P=W+S+R+S+R+S).

In the washing machine (1) of the present invention, the ozone gas generated by the ozone generator (4) is delivered into the tub (2) only during the spin drying steps (S) wherein the drum (3) is rotated at high speed.

In the washing machine (1), at the spin drying steps (S), clothes rotate with the drum (3) without falling by clinging to the inner wall of the drum (3) rotating at high speed and the ozone gas heading from the center to the inner wall of the drum (3) is provided to penetrate into the clothes completely. Furthermore, the water particles dispersing around in the drum (3) by means of the centrifugal force formed in the drum provide the ozone gas to be carried onto clothes and the effect of the ozone gas on clothes is increased.

In another embodiment of the present invention, in the washing machine (1), the ozone generator (4) is operated continuously before the spin drying step (S) starts, for example beginning from the main washing (W) step at the beginning of the washing program (P), however the ozone gas is started to be delivered into the tub (2) beginning from the start of the spin drying step (S). Thus, by the start of the spin drying step (S) in the washing program (P), the amount of the ozone gas generated by the ozone generator (4) is provided to reach an appropriate level for the spin drying step (S). Since the ozone gas is delivered into the tub (2) only at the spin drying steps (S) and not delivered into the tub (2) at the main washing (W) step, the ozone gas is prevented from adversely affecting the chemical composition of the detergent used in the main washing (W).

Figure 1:
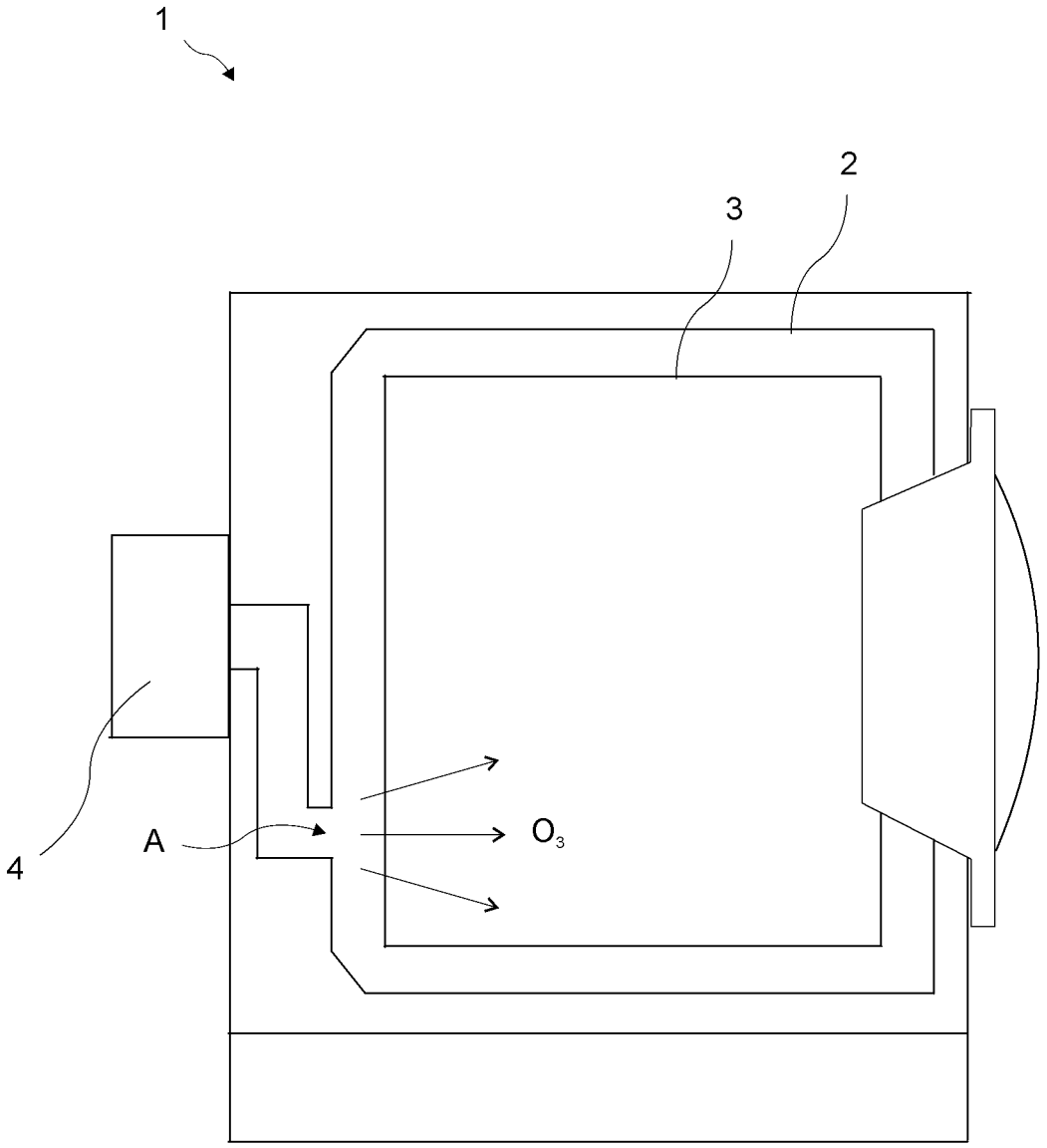
FIG. 1—is the schematic view of a washing machine comprising an ozone generator.
Figure 2:
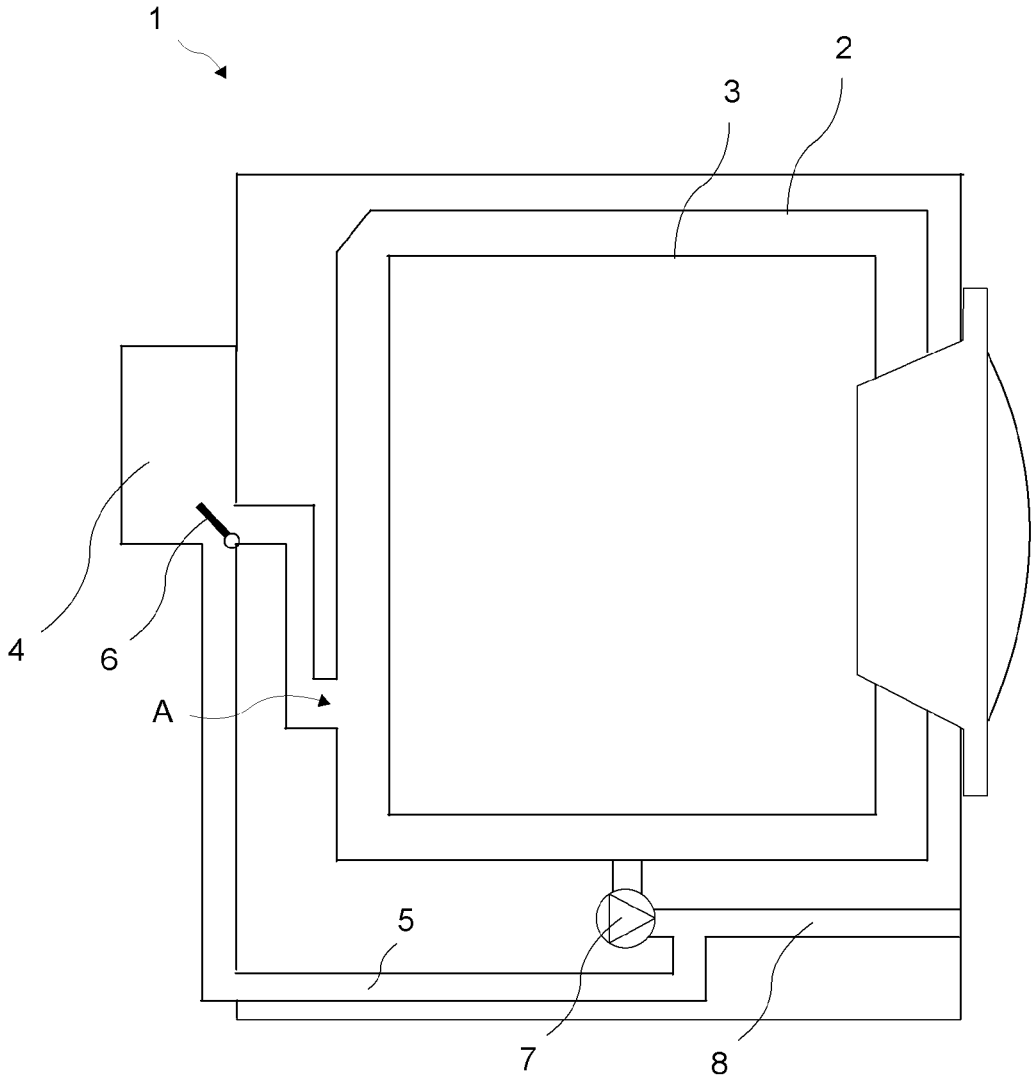
FIG. 2—is the schematic view of a washing machine comprising an ozone generator and an ozone discharge conduit.

In this embodiment, the washing machine (1) comprises an ozone discharge conduit (5) providing the evacuation of the ozone gas generated by the ozone generator (4) which starts operating before the spin drying step (S) and a valve (6) providing the direction of the ozone gas from the ozone generator (4) to the ozone discharge conduit (5) except during the spin drying step and from the ozone generator (4) into the tub (2) during the spin drying step (S) (FIG. 2).

In another embodiment of the present invention, the washing machine (1) comprises a draining pump (7) discharging the wash water at the end of the washing process and a waste water discharge conduit (8) providing the waste water to be discharged by means of the draining pump (7); the ozone discharge conduit (5) is connected to the waste water discharge conduit (8) and the ozone gas discharged at the spin drying steps (S) is provided to be evacuated by means of the waste water discharge conduit (8) (FIG. 2). Thus, unused ozone gas is discharged and at the same time microorganism accumulation and generation of unpleasant odor in the waste water discharge conduit (8) are prevented.

Figure 3:
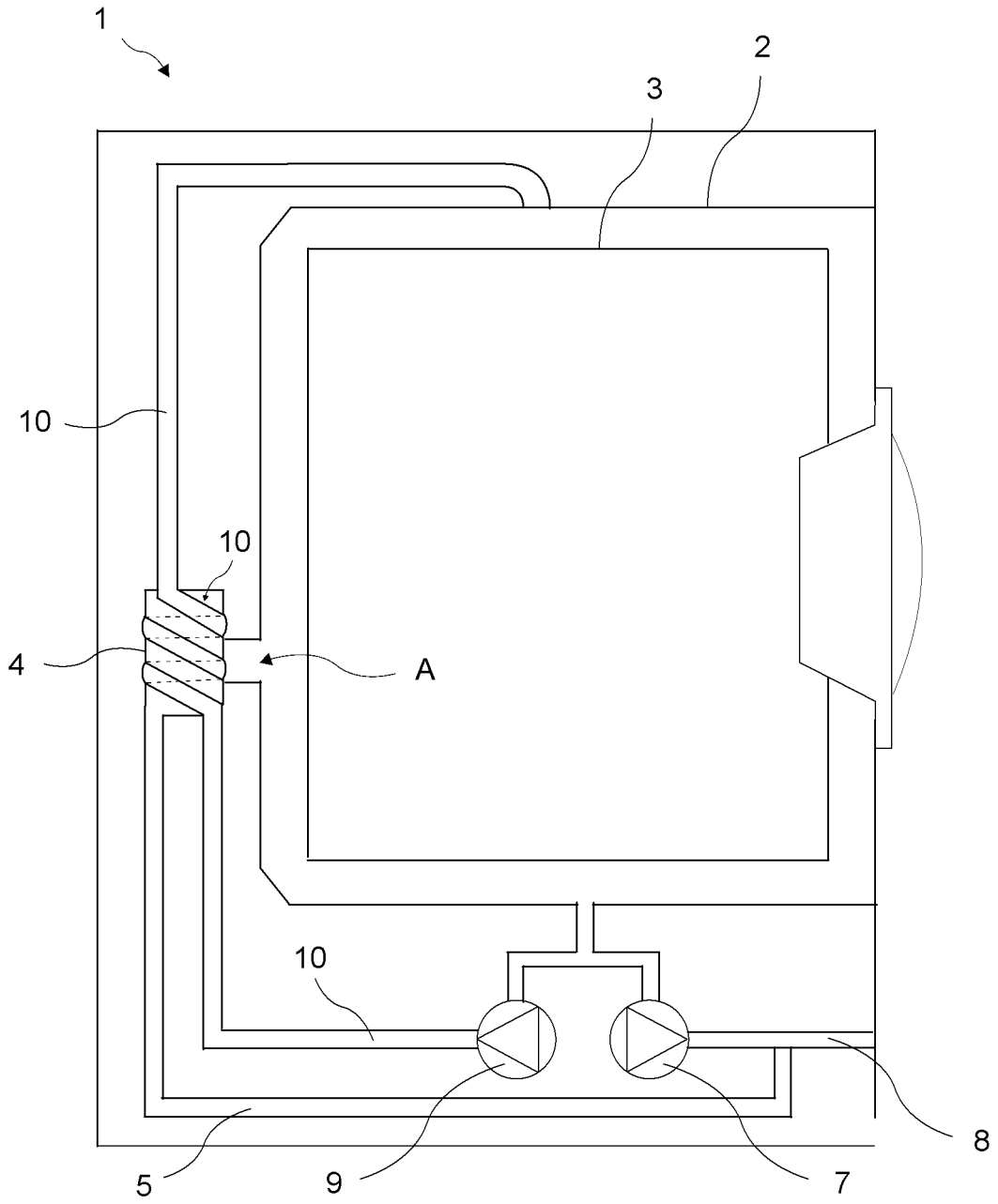
FIG. 3—is the schematic view of a washing machine comprising an ozone generator, an ozone discharge conduit and a circulation line cooling the ozone generator.

In another embodiment of the present invention, in the washing machine (1), the ozone generator (4) overheating during operation is cooled by the water used in washing. In this embodiment, the washing machine (1) comprises a circulation pump (9) providing the return of the wash water received from the tub (2) during washing and a circulation line (10) carrying the wash water moved by the circulation pump (9) to the tub (2), and the circulation line (10) provides the ozone generator (4) to be cooled by contacting it. The portion of the circulation line (10) contacting the ozone generator (4) surrounds the ozone generator (4) preferably like a coil (FIG. 3).

The circulation line (10) serves as a heat exchanger and provides the ozone generator (4) to operate effectively by cooling the ozone generator (4) since the temperature of the water flowing in the circulation line (10) contacting the ozone generator (4) is lower than the temperature of the operating ozone generator (4).

In the washing machine (1) of the present invention, the efficiency of the ozone gas generated by the ozone generator (4) and delivered into the tub (2) at the spin drying steps (S) is increased by being carried onto the clothes on the inner walls of the drum (3) by the water particles dispersing around by the effect of the centrifugal force.

The ozone generator (4) can be operated efficiently for a long time without interruption throughout the washing program (P) by being cooled with the water used in washing.

The ozone gas is delivered directly to the washing medium in the tub (2); thus, there is no need for additional components such as Venturi tube, diffuser etc. used in embodiments wherein ozone is dissolved in the wash water.

Since the ozone gas is not delivered to the washing medium at the main washing step (W) wherein the detergent is in the washing medium during the washing process, the adverse effect of the ozone gas on the detergent is prevented.

The invention claimed is:

1. A washing machine (1) comprising a tub (2) wherein a washing operation is performed, a drum (3) positioned inside the tub (2) agitating laundry emplaced therein and an ozone generator (4) generating ozone gas ($O_3$) and delivering the ozone gas into the tub (2) by means of an opening (A) arranged on the tub (2), wherein the ozone generator (4) can only deliver ozone gas into the tub (2) during any spin drying steps (S) wherein the drum (3) is rotated at high speed of the washing machine and wherein the ozone generator (4) being operated before the spin drying step (S) starts and wherein the generated ozone gas is started to be delivered into the tub (2) beginning from the start of the spin drying step (S) and further comprising a draining pump (7) discharging the wash water at the end of the washing process, a waste water discharge conduit (8) providing the waste water to be discharged by means of the draining pump (7) and the ozone discharge conduit (5) connected to the waste water discharge conduit (8) and further comprising a valve (6) providing the ozone gas to be directed from the ozone generator (4) to the ozone discharge conduit (5) except during the spin drying step (S) and from the ozone generator (4) into the tub (2) during the spin drying step (S) and further comprising a circulation pump (9) providing the return of the wash water received from the tub (2) during washing and a circulation line (10) in contact with the ozone generator (4) and carrying the wash water moved by the circulation pump (9) to the tub (2).

2. The washing machine (1) as in claim 1, wherein the circulation line (10), wherein the portion contacting the ozone generator (4) surrounds the ozone generator (4) like a coil.

3. A washing machine (1) comprising a tub (2) wherein a washing operation is performed, a drum (3) positioned inside the tub (2) agitating laundry emplaced therein and an ozone generator (4) generating ozone gas ($O_3$) and delivering the ozone gas into the tub (2) by means of an opening (A) arranged on the tub (2), wherein the ozone generator (4) can only deliver ozone gas into the tub (2) during any spin drying steps (S) wherein the drum (3) is rotated at high speed of the washing machine and wherein the ozone generator (4) being operated before the spin drying step (S) starts and wherein the generated ozone gas is started to be delivered into the tub (2) beginning from the start of the spin drying step (S) and and further comprising an ozone discharge conduit (5) providing the ozone gas generated by the ozone generator (4) which starts operating before the spin drying step (S) to be evacuated and further comprising a valve (6) providing the ozone gas to be directed from the ozone generator (4) to the ozone discharge conduit (5) except during the spin drying step (S) and from the ozone generator (4) into the tub (2) during the spin drying step (S) and further comprising a circulation pump (9) providing the return of the wash water received from the tub (2) during washing and a circulation line (10) in contact with the ozone generator (4) and carrying the wash water moved by the circulation pump (9) to the tub (2).

4. The washing machine (1) as in claim 3, wherein the circulation line (10), wherein the portion contacting the ozone generator (4) surrounds the ozone generator (4) like a coil.

* * * * *